US007290731B1

(12) United States Patent
Tabor et al.

(10) Patent No.: US 7,290,731 B1
(45) Date of Patent: Nov. 6, 2007

(54) KITE LINE REEL WITH FIRST AND SECOND CAMMED BRAKE FEATURE

(76) Inventors: Don Tabor, 30765 Pacific Coast Hwy., Suite 300, Malibu, CA (US) 90265; Francis Alonso, 30765 Pacific Coast Hwy., Suite 300, Malibu, CA (US) 90265

( * ) Notice: Subject to any disclaimer, the term of this patent is extended or adjusted under 35 U.S.C. 154(b) by 204 days.

(21) Appl. No.: 11/151,782

(22) Filed: Jun. 13, 2005

Related U.S. Application Data

(60) Provisional application No. 60/671,261, filed on Apr. 13, 2005.

(51) Int. Cl.
*B65H 75/30* (2006.01)

(52) U.S. Cl. ..... 242/396.9; 242/396.7; 242/423.1; 242/291

(58) Field of Classification Search ..... 242/396.5, 242/423, 423.1, 423.2, 588, 588.1, 588.2, 242/396.6, 396.7, 396.9, 396.1, 396, 245, 242/286, 291–294, 298, 304, 309; 188/71.4, 188/71.5, 72.8; 192/215, 223.3
See application file for complete search history.

(56) References Cited

U.S. PATENT DOCUMENTS

| | | | | | |
|---|---|---|---|---|---|
| 560,925 | A * | 5/1896 | Pflueger | ..... | 242/396.7 |
| 2,198,231 | A * | 4/1940 | Schafer | ..... | 242/286 |
| 2,221,852 | A * | 11/1940 | Torrence | ..... | 242/291 |
| 2,249,433 | A * | 7/1941 | Palmer | ..... | 242/396.1 |
| 2,826,377 | A * | 3/1958 | Florent | ..... | 242/395 |
| 2,923,490 | A * | 2/1960 | Smith | ..... | 242/396.7 |
| 2,961,184 | A * | 11/1960 | Alford | ..... | 242/396.7 |
| 4,111,387 | A * | 9/1978 | Leary | ..... | 244/155 A |
| 5,238,201 | A * | 8/1993 | Jonushaitis | ..... | 242/396.8 |
| 6,254,020 | B1 * | 7/2001 | Nilsen | ..... | 242/255 |
| 6,964,388 | B1 * | 11/2005 | Ritter | ..... | 242/291 |

* cited by examiner

*Primary Examiner*—Peter M. Cuomo
*Assistant Examiner*—William E Dondero

(57) ABSTRACT

A kite reel has a spool rotatable on a shaft to reel in or out kite line attached to a flying kite. A brake disk coaxial with the spool on the same shaft is moved translationally to and from the spool to block or unblock the spool rotation on a central brake disk cam defined by the shaft. A peripheral brake disk cam is engaged by a thumb wheel driven cam to rotate the brake disk on the first cam into or out of spool contact.

19 Claims, 3 Drawing Sheets

KITE LINE REEL WITH FIRST AND SECOND CAMMED BRAKE FEATURE

CROSS-REFERENCE TO RELATED APPLICATIONS

This application claims the benefit of U.S. Provisional Application Ser. No. 60/671,261, filed Apr. 13, 2005.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to kite reels, namely devices for paying a kite line in or out, and for controlling the position and maneuvers of a kite. More particularly, the invention relates to kite line reels having two cammed surfaces for shifting a brake translationally on a first central cam by second cam force on the brake periphery to and from engagement with the kite reel spool, using only the thumb of the hand holding the kite reel for one-handedly braking or releasing kite line movement.

2. Description of the Related Art

Kite reels are well known. As known, they lack convenience, controllability, braking features, and/or effectiveness for the kite flying enthusiast.

BRIEF SUMMARY OF THE INVENTION

It is an object of the present invention to provide a kite reel that overcomes the deficiencies of the prior art. It is another object to provide a readily handled kite reel. It is a further object to provide a kite reel with an integral braking system control by just the thumb of the hand that grips the reel. Another object is to provide a kite braking system including a spool and a brake reel that is cammed to the shaft that journals the spool for translational shifting under a peripheral cam operated by the thumb. Yet another object is to provide a kite reel and method wherein the paying out or reeling in of kite line is controlled by rotating the spool in concert with selective application of braking by the brake disk rotated in cammed relation to and from the spool under a second cam peripheral to the brake disk. Other objects will appear hereinafter.

These and other objects of the invention are realized in a hand-held kite line reel for controlling the payout and return of line attached to a flying kite, the kite line reel comprising a rotatable spool for carrying the line and rotatable brake disk coaxial therewith, cooperating cam structures shifting the brake to and from braking engagement with the spool responsive to brake disk rotation, and a brake disk driver operable by the thumb of the hand holding the reel for rotating the brake disk.

In this and like embodiments of the invention, typically, the reel further includes a shaft about which the spool rotates, and a frame supporting the shaft, the brake disk rotates about the shaft, the shaft has a cam portion opposite the brake disk, the brake disk has a cooperating cam portion for translational movement along the shaft to and from engagement with the spool, the shaft is cam portion-free opposite the spool, the spool has a flange opposing the brake disk arranged for engagement with the brake disk in spool braking relation upon engagement of the brake disk with the spool flange, the spool comprises a hub for winding kite string and having first and second ends, the flange is a first spool flange and is at the spool first end, and including also a second spool flange at the spool second end, and a winding handle carried on the second spool flange in pivoting relation for rotating the spool in line winding or unwinding relation, there can also be included a frame having a hand grip.

Further, typically, the reel has a shaft mounting arm for supporting the shaft in spool rotatable relation, the brake disk has a peripheral cam portion, the shaft is a first shaft, and including also a second shaft supported by the arm parallel to the first shaft, and a brake disk driver supported on the second shaft in rotatable relation, the brake disk driver being arranged to drive the brake disk angularly in brake disk peripheral cam portion-engaged relation, the brake disk being shifted translationally by its rotational engagement with the shaft cam portion, the brake disk peripheral cam portion defines gear teeth, the brake disk driver having cooperating gear teeth peripherally arranged on the driver for camming engagement with the brake disk gear teeth, a thumb pad is attached to the brake disk driver for driving the driver responsive to thumb pressure on the thumb pad, the thumb pad is generally cylindrical and journaled on the second shaft with the brake driver disk, and rotation of the thumb pad about the second shaft driving the brake disk driver rotationally in a forward or reverse direction, rotation of the brake disk driver driving the brake disk in the opposite direction from the brake disk driver and correspondingly shift the brake disk to or from engagement with the spool first flange translationally as a function of the break disk rotation on the first shaft cam portion.

In a further embodiment, there is provided a hand-held kite reel for controlling the payout and return of line attached to a flying kite, the kite line reel comprising a frame having a hand grip and supporting a first shaft, rotatable spool journaled on the first shaft, a brake disk journaled on the first shaft coaxial with the spool, a first cam pair defined by the first shaft and the brake disk central portion for urging the brake disk translationally in brake disk rotation responsive relation, a second shaft supported by the frame parallel with the first shaft, a thumb wheel journaled on the second shaft, a second cam pair including a cam member fixed to the thumb wheel for rotation therewith under thumb pressure from the hand holding the reel hand grip and a cam surface on the periphery of the brake disk to peripherally drive the brake disk rotationally to and from engagement with the spool via the first cam pair in spool rotation braking and releasing relation respectively.

In a further embodiment, the invention provides a hand-held kite line reel for controlling the payout and return of line attached to a flying kite, the kite line reel comprising a frame carrying a rotatable spool for carrying the line, a brake disk coaxial with the spool, a first cam centrally engaged with the brake disk for urging the brake disk translationally in brake disk rotation responsive relation, and a second cam arranged to peripherally drive the brake disk for peripherally driving the brake disk rotationally on the first cam to and from engagement with the spool in spool rotation braking and releasing relation respectively, the second cam being thumb-operable by the hand holding the reel.

In this and like embodiments, typically, the reel further comprises a shaft supported by the frame, the shaft supporting the spool and brake disk in rotatable relation, the shaft having a camming portion defining the first cam and engaged with the brake disk but not the spool for urging the brake disk translationally toward or from the spool upon brake disk rotation, and the reel further comprises a second shaft supported by the frame, the second shaft supporting the second cam in rotatable relation, the second cam having peripheral cam surfaces, the brake disk having peripheral cam surfaces cooperating with the second cam peripheral cam surfaces to drive the spool rotationally.

In its method aspects, the invention provides a method of flying a kite on a variable paid out length of kite line extended from a kite reel rotatable spool, including rotating the spool to increase or decrease paid out line, selectively shifting a brake disk having a central cam translationally to and from the spool to block or unblock spool rotation, and driving the brake disk with a thumb-operated peripheral cam to rotate the brake disk on its central cam in translationally shifting relation for spool blocking and unblocking to control spool rotation to increase or decrease the length of paid out kite line.

BRIEF DESCRIPTION OF THE SEVERAL VIEWS OF THE DRAWINGS

The invention will be further described in conjunction with the attached drawings in which.

DETAILED DESCRIPTION OF THE INVENTION

Figure 5:
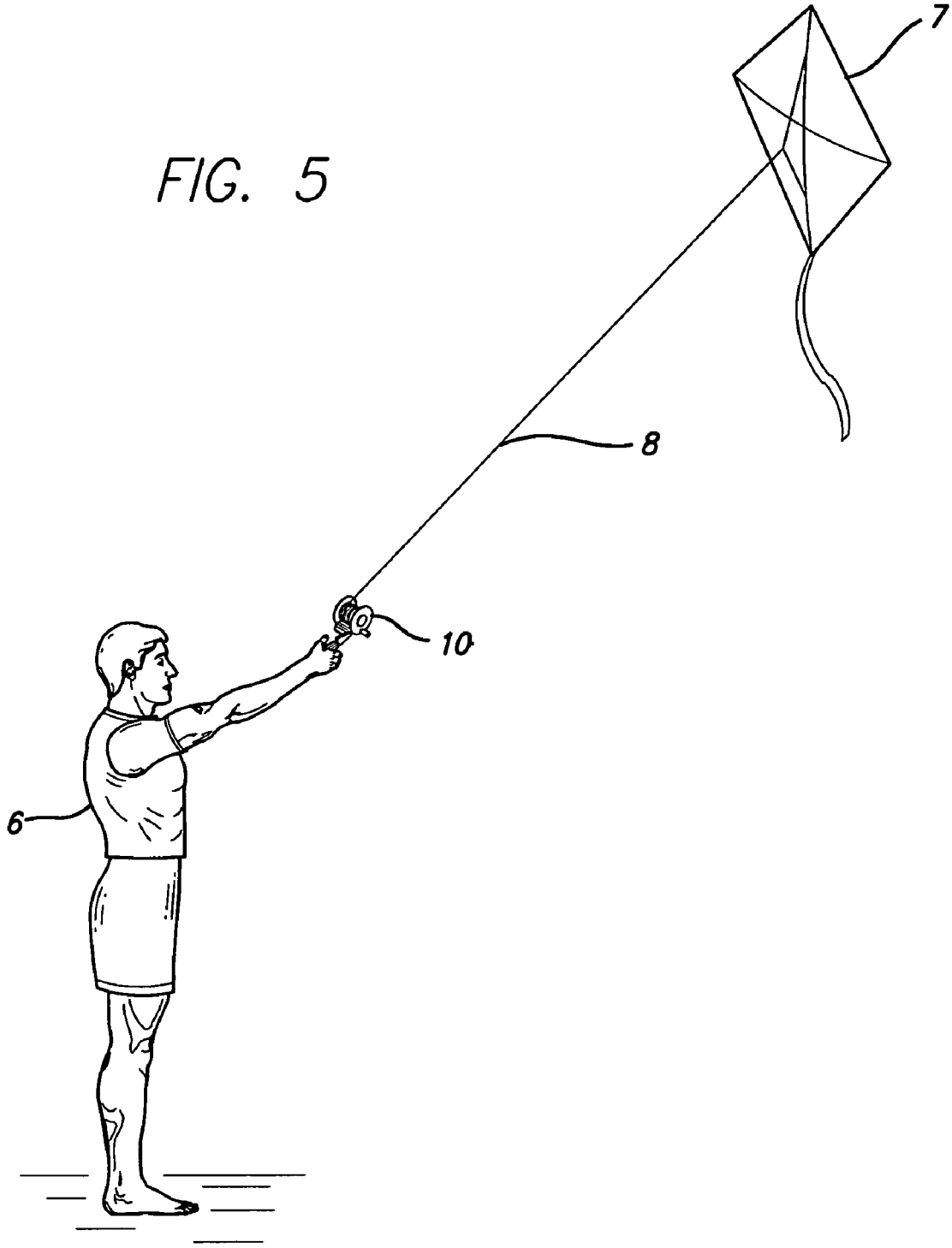
FIG. 5 is a pictorial view of the reel in use flying a kite.

With reference now to the drawings, in FIG. 5 a kite flyer 6 holds reel 10 controlling kite 7 with line 8.

Figure 1:
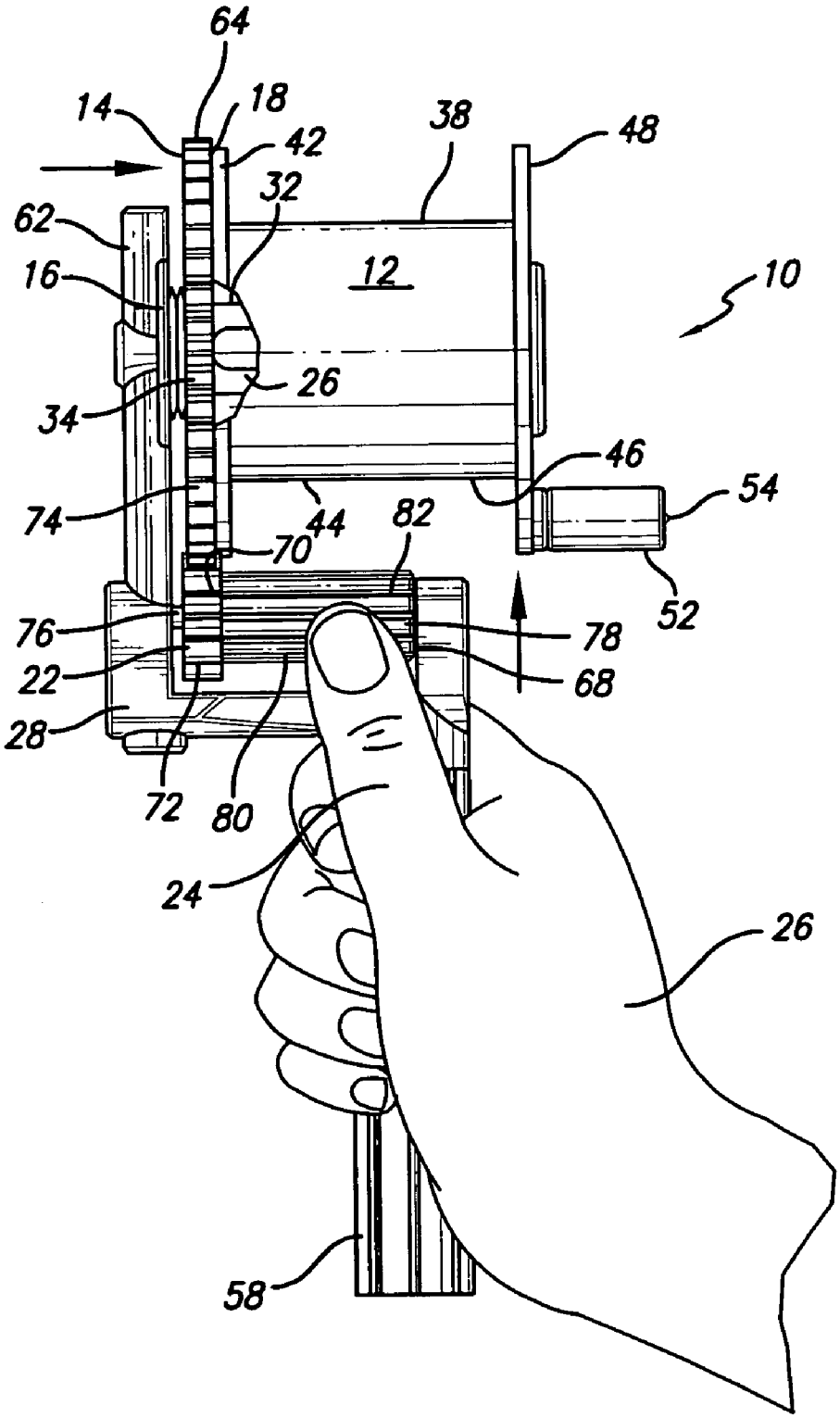
FIG. 1 is a rear elevation view of the invention kite line reel with the brake disk engaged.
Figure 2:
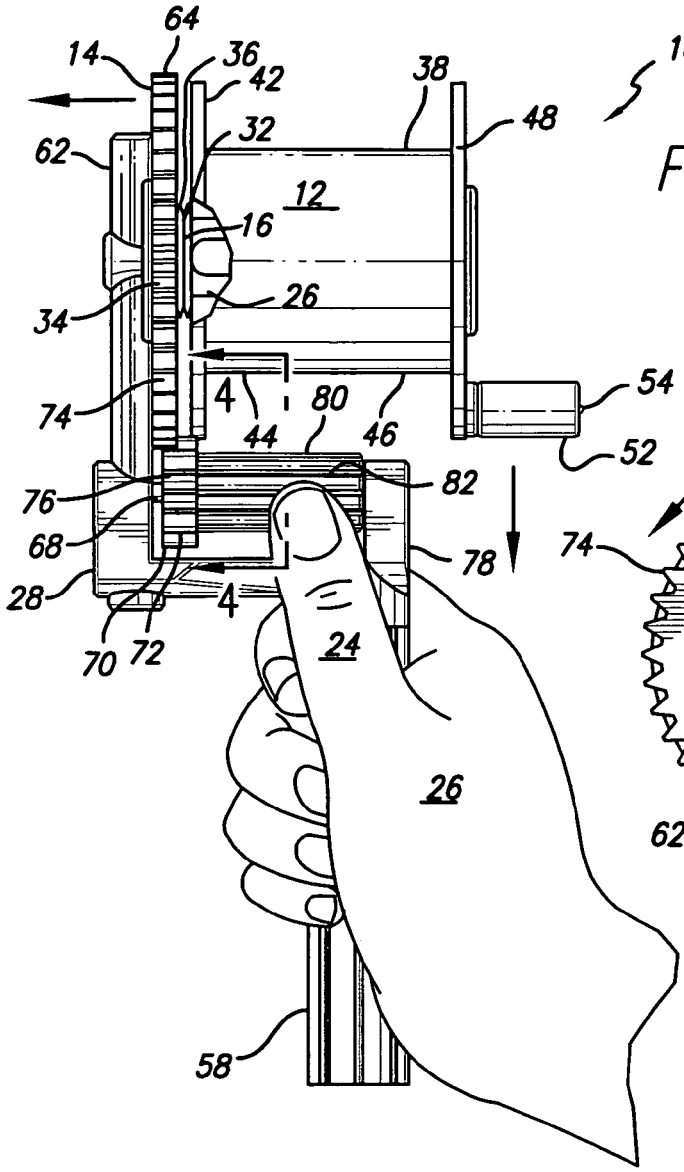
FIG. 2 is a view like FIG. 1 with the brake disk not engaged.
Figure 3:
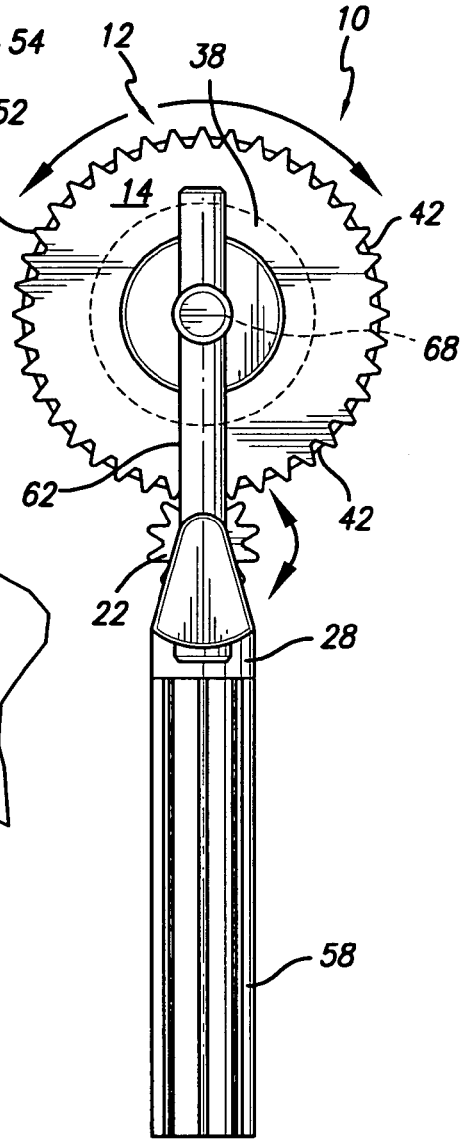
FIG. 3 is a side elevation view of the kite line reel.
Figure 4:
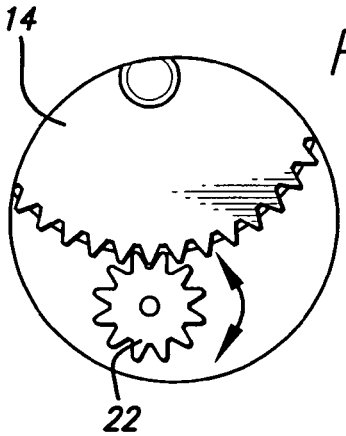
FIG. 4 is a view taken on line 4-4 in FIG. 2.

In FIGS. 1-3 the invention hand-held kite line reel is shown at 10 to include a spool 12 upon which kite line is to be wound and unwound for controlling the payout and return of the line when attached to a flying kite.

Kite line reel 10 comprises the rotatable spool 12 for carrying the line (not shown here for clarity) and a rotatable brake disk 14 coaxial therewith. Cooperating cam structures 16 shift the brake disk 14 to and from braking engagement at 18 with the spool 12 responsive to brake disk rotation. Brake disk driver 22 is operable for forward and reverse rotation by the thumb 24 of the hand 26 holding the reel 10 for rotating the brake disk 14.

Reel 10 has a shaft 26 about which the spool 12 rotates and a frame 28 supporting the shaft. Brake disk 14 rotates about the shaft 26. Shaft 26 has a cam portion 32 opposite the central portion or hub 34 of the brake disk 14. Brake disk 14 has a cooperating cam portion 36 which when rotated and engaged with the shaft cam portion 32 provides translational movement of the brake disk along the shaft to and from engagement with the spool 12; compare FIGS. 1 and 2. Typically the shaft 26 is cam portion 32-free opposite the spool 12 so that the shaft opposite the hub 38 of the spool is smooth for free turning of the spool.

Spool 12 generally has a flange 42 opposing the brake disk 14 and arranged for engagement with the brake disk in spool braking relation upon engagement of the brake disk with the spool flange (FIG. 2). Spool hub 38 is adapted for winding kite string and has first and second ends 44, 46. Flange 42 is a first spool flange and is at the spool first end 44. Brake disk 14 becomes frictionally engaged with flange 42 to frictionally slow or stop the rotation of spool 12.

Flange 48 is a second spool flange located at the spool second end 46. Winding handle 52, ovoid in cross-section for increased control, is carried on pin 54 fixed in second spool flange 48 in pivoting relation for epicyclic rotation relative to the spool flange. Moving, by hand, the winding handle 52 in a circle rotates the spool 12 in kite line winding or unwinding relation.

Reel 10 also includes frame 28 supporting the various components noted above and having a hand grip 58. For supporting the above components, reel frame 28 has a shaft mounting arm 62 for supporting the shaft 26 in spool rotatable relation. Brake disk 14 journaled on shaft 26 coaxially with the spool hub 38 has a peripheral cam portion 64. Shaft 26 is a first shaft. A second shaft 68 is also supported by the arm 62 and parallel to the first shaft. A brake disk driver 72 is rotatably supported on the second shaft 68. Brake disk driver 72 drives the brake disk 14 angularly, forward or back, see FIG. 3, in brake disk peripheral cam portion 64-engaged relation. The ensuing rotation of the brake disk 14 results in the brake disk being shifted translationally left and right by the engagement of its cam portion 36 with the shaft cam portion 32.

Preferably, the brake disk peripheral cam portion 64 defines spur gear teeth 74. Brake disk driver 72 has cooperating cam elements 70 comprising spur gear teeth 76 peripherally arranged on the driver for camming engagement with the brake disk gear teeth.

A thumb pad 78 is attached to the brake disk driver 72 for driving the driver responsive to thumb 24 pressure on the thumb pad. The thumb pad 78 is a generally cylindrical thumb wheel 80 and journaled on the second shaft 68 with the brake disk driver 72, and can be knurled as shown at 82 for better purchase. As will be evident from the description thusfar, rotation of the thumb pad about the second shaft 68 drives the brake disk driver 72 fixed thereto rotationally in a forward or reverse direction, while rotation of the brake disk driver drives the brake disk 14 in the opposite direction (clockwise to counterclockwise and vice-versa) from the brake disk driver and correspondingly shifts the brake disk to or from engagement with the spool first flange 42 translationally as a function of the brake disk rotation on the first shaft cam portion 32.

More particularly, the invention kite line reel 10 comprises frame 28 having a hand grip 58 and supporting a first shaft 26, a rotatable spool 12 journaled on the first shaft, a brake disk 14 journaled on the first shaft and coaxial with the spool, a first cam pair 32, 36 defined by the first shaft and the brake disk central portion 34 for urging the brake disk translationally in brake disk rotation responsive relation, a second shaft 68 supported by the frame parallel with the first shaft, a thumb wheel 80 journaled on the second shaft, a second cam pair 64, 70 including a cam member disk driver 72 fixed to the thumb wheel for rotation therewith under thumb 24 pressure from the hand holding the reel hand grip 58 and a cam surface 64 on the periphery of the brake disk to peripherally drive the brake disk rotationally to and from engagement with the spool via the first cam pair in spool rotation braking and releasing relation respectively.

In a further embodiment, the invention provides hand-held kite line reel 10 for controlling the payout and return of line 8 attached to a flying kite 7, the kite line reel comprising a frame 28 carrying a rotatable spool 12 for carrying the line, a brake disk 14 coaxial with the spool, a first cam 32 centrally engaged with the brake disk for urging the brake disk translationally in brake disk rotation responsive relation, and a second cam 64 arranged to peripherally drive the brake disk for peripherally driving the brake disk rotationally on the first cam to and from engagement with the spool in spool rotation braking and releasing relation respectively, the second cam being thumb-operable by the hand 26 holding the reel.

In this and like embodiments, typically, the reel 10 further comprises a shaft 26 supported by the frame 28, the shaft supporting the spool 12 and brake disk 14 in rotatable relation, the shaft having a camming portion 32 defining the first cam and engaged with the brake disk but not the spool for urging the brake disk translationally toward or from the spool upon brake disk rotation, and the reel further comprises a second shaft 68 supported by the frame, the second shaft supporting the second cam 64 in rotatable relation, the second cam having peripheral cam surfaces, the brake disk having peripheral cam surfaces cooperating with the second cam peripheral cam surfaces to drive the spool rotationally.

In its method aspects, the invention provides a method of flying a kite on a variable paid out length of kite line extended from a kite reel rotatable spool 12, including rotating the spool to increase or decrease paid out line, selectively shifting a brake disk 14 having a central cam 36 translationally to and from the spool to block or unblock spool rotation, and driving the brake disk with a thumb-operated peripheral cam 64 to rotate the brake disk on its central cam in translationally shifting relation for spool blocking and unblocking to control spool rotation to increase or decrease the length of paid out kite line.

The invention thus provides a kite reel that overcomes the deficiencies of the prior art and that is readily handled. The invention kite reel has an integral braking system control by just the thumb of the hand that grips the reel, the braking system including a spool and a brake reel that is cammed to the shaft that journals the spool for translational shifting under a peripheral cam operated by the thumb, so that the paying out or reeling in of kite line is controlled by rotating the spool in concert with selective application of braking by the brake disk rotated in cammed relation to and from the spool under a second cam peripheral to the brake disk.

The foregoing objects are thus met.

We claim:

1. A hand-held kite line reel for controlling the payout and return of line attached to a flying kite, said kite line reel comprising on a first shaft a rotatable spool for carrying said line and rotatable brake disk coaxial therewith, cooperating cam structures shifting said brake disk to and from braking engagement with said spool responsive to brake disk rotation, and on a second shaft parallel with said first shaft a brake disk driver operable by the thumb of the hand holding said reel for rotating said brake disk.

2. The hand-held kite line reel according to claim 1, further comprising a frame supporting said first and second shafts.

3. The hand-held kite line reel according to claim 2, in which said brake disk rotates about said first shaft.

4. The hand-held kite line reel according to claim 3, in which said first shaft has a cam portion opposite said brake disk, said brake disk having a cooperating cam portion for translational movement along said first shaft to and from engagement with said spool.

5. The hand-held kite line reel according to claim 4, in which said first shaft is cam portion free opposite said spool.

6. The hand-held kite line reel according to claim 4, in which said spool has a flange opposing said brake disk arranged for engagement with said brake disk in spool braking relation upon engagement of said brake disk with said spool flange.

7. The hand-held kite line reel according to claim 6, in which said spool comprises a hub for winding kite string and having first and second ends, said flange is a first spool flange and is at said spool first end, and including also a second spool flange at said spool second end, and a winding handle carried on said second spool flange in pivoting relation for rotating said spool in line winding or unwinding relation.

8. The hand-held kite line reel according to claim 7, said frame having a hand grip and a shaft mounting arm for supporting said first shaft in spool rotatable relation.

9. A hand-held kite line reel for controlling the payout and return of line attached to a flying kite, said kite line reel comprising a rotatable spool for carrying said line and rotatable brake disk coaxial therewith and having a peripheral cam portion, cooperating cam structures shifting said brake disk to and from braking engagement with said spool responsive to brake disk rotation, and a brake disk driver operable by the thumb of the hand holding said reel for rotating said brake disk.

10. The hand-held kite line reel according to claim 9, in which said shaft is a first shaft, and including also a second shaft supported by an arm parallel to said first shaft, said a brake disk driver being supported on said second shaft in rotatable relation, said brake disk driver being arranged to drive said brake disk angularly in brake disk peripheral cam portion-engaged relation, said brake disk being shifted translationally by its rotational engagement with said shaft cam portion.

11. The hand-held kite line reel according to claim 10, in which said brake disk peripheral cam portion defines gear teeth, said brake disk driver having cooperating gear teeth peripherally arranged on said driver for camming engagement with said brake disk gear teeth.

12. The hand-held kite line reel according to claim 11, including also thumb pad attached to said brake disk driver for driving said driver responsive to thumb pressure on said thumb pad.

13. The hand-held kite line reel according to claim 12, in which said thumb pad is generally cylindrical and journaled on said second shaft with said brake driver disk, rotation of said thumb pad about said second shaft driving said brake disk driver rotationally in a forward or reverse direction, rotation of said brake disk driver driving said brake disk in the opposite direction from the brake disk driver and correspondingly shift said brake disk to or from engagement with said spool first flange translationally as a function of said break disk rotation on said first shaft cam portion.

14. A hand-held kite reel for controlling the payout and return of line attached to a flying kite, said kite line reel comprising a frame having a hand grip and supporting a first shaft, rotatable spool journaled on said first shaft, a brake disk journaled on said first shaft coaxial with said spool, a first cam pair defined by said first shaft and said brake disk central portion for urging said brake disk translationally in brake disk rotation responsive relation, a second shaft supported by said frame parallel with said first shaft, a thumb wheel journaled on said second shaft, a second cam pair including a cam member fixed to said thumb wheel for rotation therewith under thumb pressure from the hand holding said reel hand grip and a cam surface on the periphery of said brake disk to peripherally drive said brake disk rotationally to and from engagement with said spool via said first cam pair in spool rotation braking and releasing relation respectively.

15. A hand-held kite line reel for controlling the payout and return of line attached to a flying kite, said kite line reel comprising a frame carrying a rotatable spool for carrying said line, a brake disk coaxial with said spool, a first cam centrally engaged with said brake disk for urging said brake disk translationally in brake disk rotation responsive relation, and a second cam arranged to peripherally drive said brake disk for peripherally driving said brake disk rotationally on said first cam to and from engagement with said spool in spool rotation braking and releasing relation respectively, said second cam being thumb-operable by the hand holding said reel.

16. The hand-held kite line reel according to claim 15, in which said reel further comprises a shaft supported by said frame, said shaft supporting said spool and brake disk in rotatable relation, said shaft having a camming portion defining said first cam and engaged with said brake disk but not said spool for urging said brake disk translationally toward or from said spool upon brake disk rotation.

17. The hand-held kite line reel according to claim 16, in which said shaft is a first shaft, and said reel further comprises a second shaft supported by said frame, said second shaft supporting said second cam in rotatable relation, said second cam having peripheral cam surfaces, said brake disk having peripheral cam surfaces cooperating with said second cam peripheral cam surfaces to drive said spool rotationally.

18. The hand-held kite line reel according to claim 15, in which said reel further comprises a shaft supported by said frame, said shaft supporting said second cam in rotatable relation, said second cam having peripheral cam surfaces, said brake disk having peripheral cam surfaces cooperating with said second cam peripheral cam surfaces to drive said spool rotationally.

19. A method of flying a kite on a variable paid out length of kite line extended from a kite reel rotatable spool, including rotating said spool to increase or decrease paid out line, selectively shifting a brake disk having a peripheral cam and a central cam translationally to and from said spool to block or unblock spool rotation, and driving said brake disk by its said peripheral cam with a thumb-operated second peripheral cam to rotate said brake disk on its central cam in translationally shifting relation for spool blocking and unblocking to control spool rotation to increase or decrease the length of paid out kite line.

* * * * *